US006928271B2

(12) United States Patent
Fish et al.

(10) Patent No.: US 6,928,271 B2
(45) Date of Patent: Aug. 9, 2005

(54) BISTABLE CHIRAL NEMATIC LIQUID CRYSTAL DISPLAY AND METHOD OF DRIVING THE SAME

(75) Inventors: David A. Fish, Haywards Heath (GB); Neil C. Bird, Horsham (GB)

(73) Assignee: Koninklijke Philips Electronics N.V., Eindhoven (NL)

( * ) Notice: Subject to any disclaimer, the term of this patent is extended or adjusted under 35 U.S.C. 154(b) by 198 days.

(21) Appl. No.: 10/106,980

(22) Filed: Mar. 26, 2002

(65) Prior Publication Data

US 2002/0149552 A1 Oct. 17, 2002

(30) Foreign Application Priority Data

Apr. 11, 2001 (GB) ..... 0109015

(51) Int. Cl.[7] ..... G09G 3/36

(52) U.S. Cl. ..... 455/97; 345/90; 345/94; 345/99; 345/84

(58) Field of Search ..... 455/97, 92, 91, 455/93, 94, 95, 96, 84, 86, 87, 88, 89, 90, 99

(56) References Cited

U.S. PATENT DOCUMENTS 5,977,944 A 11/1999 Kubota et al. ..... 345/100
6,052,103 A 4/2000 Fujiwara et al. ..... 345/89
6,295,044 B1 * 9/2001 Geisow et al. ..... 345/97
6,518,944 B1 * 2/2003 Doane et al. ..... 345/87
6,633,306 B1 * 10/2003 Marz et al. ..... 345/698
2002/0000967 A1 * 1/2002 Huston et al. ..... 345/88

FOREIGN PATENT DOCUMENTS

DE 19811022 A 6/1999 ..... G09G/3/36
WO WO9921052 4/1999 ..... G02F/1/37

OTHER PUBLICATIONS

L.C. Chien et al, "Multicolour Reflective Cholesteric Displays", SID 95, p. 169.
J.Y. Nahm, et al., "Amorphous Silicon Thin–Film Transistor Active–Matrix Reflective Cholesteric Liquid Crystal Display," Asia Display 98, 979–982.

* cited by examiner

*Primary Examiner*—Nick Corsaro
*Assistant Examiner*—Shaima Q. Aminzay

(57) ABSTRACT

A cholesteric liquid crystal display has pixel address circuits (84) with an input (12) for receiving a data signal and a plurality of outputs, wherein each output is for applying a pixel drive signal to a respective portion of the liquid crystal material (20), and wherein the pixel drive signal for each output is independently switchable by the pixel address circuit to each output. This provides spatially-separated sub-pixels, and a number of the sub-pixels can be addressed in order to provide a grey scale output for each pixel. Each pixel drive signal can however be a two-level digital signal.

13 Claims, 3 Drawing Sheets

BISTABLE CHIRAL NEMATIC LIQUID CRYSTAL DISPLAY AND METHOD OF DRIVING THE SAME

The present invention concerns a display utilizing a chiral nematic reflective bistable liquid crystal material, and a method of driving such a display. This material is also described as cholesteric. In particular, the invention relates to an active matrix pixel arrangement and drive scheme.

Cholesteric liquid crystal material is a reflective material that provides a strongly coloured binary image. The material is bistable, has a very wide viewing angle and does not require polarisers, colour filters or rubbing as do super twisted nematic (STN) type displays. Therefore, the material can provide a low power and low cost display at high resolution and with a good quality single colour image. This type of display is being proposed for hand-held portable devices as well as for electronic document viewers, such as electronic book or newspaper devices.

Cholesteric materials have three stable states. The Planar (P) state is a reflective state of the material, and is stable with zero applied field. The Focal Conic (FC) is a transmissive scattering state of the material, and is also stable with zero applied field. The Homeotropic (H) state is stable only above a high threshold voltage of around 30V, and is also transparent. A black absorbing layer placed behind the material means that the H and FC states appear black.

A fourth, instable, state also exists, which can occur upon relaxation of the material from the H state. This is called the Transient Planar (P*) state. This state only arises if the high voltage on the material in the H state is reduced rapidly, for example in 2 ms or less. The Transient Planar state relaxes to the Planar state (P) in the absence of applied voltages.

In use of the material, a drive scheme is devised to switch the material between the P and FC states, which are stable at zero applied voltage. A first problem arises because any transition between the P and FC states requires the material to pass through the high-voltage H state. Therefore, known passive matrix switching schemes require rapid high voltage switching. Conventional drive schemes are arranged such that each time a pixel is addressed, a transition in the material is provoked into the H state. This means that pixels in the reflective P state are caused to pass through the transmissive H state, even if the pixel is to be driven to the reflective P state in the next field period. This gives rise to a visual artifact known as a black addressing bar.

The relaxation from the Homeotropic state is then controlled by the applied voltages, either to result in the Planar or Focal Conic states.

The bistable nature of the material at zero applied voltage means a display using the material does not require continuous updating or refreshing. If display information does not change, the display can be written once and remain in its information-conveying configuration for extended periods with no power consumption. This has resulted in use of cholesteric liquid crystal displays for images that can be slowly updated over relatively long periods of time. However, the problems outlined above, particularly the slow addressing response, have limited the further development of this display technology in wider fields of application.

Cholesteric liquid crystal displays provide a single colour binary image, and have been proposed principally for single colour reflective displays. In order to provide a grey scale image, rather than a binary image, it has been proposed to use the hysteresis characteristic of the cholesteric material. U.S. Pat. No. 6,052,103 discloses a display in which a grey scale is obtained by driving the material to a variable voltage. In order to provide a predictable relationship between the voltage applied to the material and the reflectivity, each pixel needs to be reset to the transmissive H state before the data signal is applied. This gives rise to the black addressing bar problem mentioned above. Furthermore, in an analogue drive scheme, the voltage on the liquid crystal material can vary during the frame period as a result of charge leakage within the pixel. This results in changes in the reflectivity during the frame period. Additional measures are required to counteract this problem.

As mentioned above, the cholesteric material provides a single colour image. In order to provide a colour display, it is known to use a tunable chiral dopant, which then controls the chirality of the liquid crystal material. Ultraviolet exposure then adjusts the chirality of the dopant and hence the liquid crystal material. In this way, the reflection wavelength of the material can be controlled by UV exposure. A small amount of polymer network forming material enables the colour to be fixed and stops diffusion of the colour, as disclosed in L. C. Chien et al, "Multicolour Reflective Cholesteric Displays", SID 95, p169, which is incorporated herein by way of reference material.

In order to provide a colour display, it has been proposed to stack display substrates having red, green and blue pixel arrays, each with their own drive electronics, or to use red, green and blue stripes of pixels on a single substrate. The latter approach is disclosed in WO99/21052, which is also incorporated herein by way of reference material.

According to the invention, there is provided a display apparatus comprising:

- a layer of bistable chiral nematic liquid crystal material;
- an active matrix substrate defining rows and columns of pixel address circuits,
- wherein each pixel address circuit has an input for receiving a data signal and a plurality of outputs, wherein each output is for applying a pixel drive signal to a respective portion of the liquid crystal material, and wherein the pixel drive signal for each output is independently switchable by the pixel address circuit to each output.

The pixel arrangement of the invention provides spatially-separated sub-pixels, and a number of the sub-pixels can be addressed in order to provide a grey scale output for each pixel. This enables each pixel drive signal to be a two-level digital signal, which avoids the problems of charge leakage associated with analogue drive schemes.

The different portions of the liquid crystal material may occupy different sized areas of the layer of material, for example following a binary-weighted scale. The number of portions then equates to the number of bits of the grey scale that can be implemented by the pixel layout.

The layer of material may comprise a red, green and blue region, so that a colour display may be implemented. For example, the layer may be arranged as an array of parallel stripes, with three stripes defining a row or column of pixels.

Each pixel preferably has a single input, and the input is coupled to each output through a respective transistor, each transistor having an independently selectable gate voltage. This enables a single drive voltage (sufficient to cause the material to pass to the Homeotropic state) to be provided to a column of pixels.

Alternatively, each pixel has a plurality of inputs, and each input is coupled to an associated output through a respective transistor, a common controllable gate voltage being applied to each transistor. This requires multiple drive voltage lines (column lines), but enables a single row voltage line to be provided for selecting the entire pixels in the row.

Preferably, the device includes a frame store. This can be used for determining which pixels need to be driven to the Homeotropic state based on the pixel outputs in the previous and current frames. This then enables the black bar problem to be avoided. The display is preferably drivable in a non-addressing mode and an addressing mode, and the frame store is then used to store data enabling transition between the two modes.

The invention also provides a method of addressing a bistable chiral nematic liquid crystal display apparatus, the apparatus comprising an active matrix substrate defining rows and columns of pixel address circuits, each pixel address circuit having a plurality of outputs, wherein each output is for applying a pixel drive signal to a respective portion of the liquid crystal material, the method comprising:

for each row of pixels, applying a pixel drive signal to a number of the outputs of each pixel address circuit, the number of the outputs being selected as a function of the desired pixel output level.

This method enables spatially-separated sub-pixels to be selected thereby enabling a grey scale to be provided whilst using digital (two-state) control of the individual sub-pixels.

The pixel drive signal is sufficient to drive the material initially to the Homeotropic state, thereby enabling transition between the P and FC states. For pixel outputs in the Planar state in the preceding frame and to be driven to the Planar state in the current frame, the pixel drive signal is not applied. This avoids the need for pixels or sub-pixels in the P state to pass through the H state when being driven again to the P state, and thereby overcomes the black bar problem.

The invention also provides a method of addressing a bistable chiral nematic liquid crystal display apparatus, the apparatus comprising an active matrix substrate defining rows and columns of pixel address circuits, the method comprising:

applying an initialisation sequence, in which for each row of pixels a pixel drive signal is applied only to those pixels previously in the transmissive Focal Conic state, thereby driving those pixels to the transmissive Homeotropic state, the state of the pixels previously being determined from a frame store.

Examples of the invention will now be described in detail with reference to the accompanying drawings, in which.

The definition of "rows" and "columns" is somewhat arbitrary in the following description and claims. These terms are intended only to signify a two dimensional array of elements, with groups of elements aligned with two orthogonal axes. Thus, a "row" or "column" may run from side to side or from top to bottom of a display.

Figure 1:
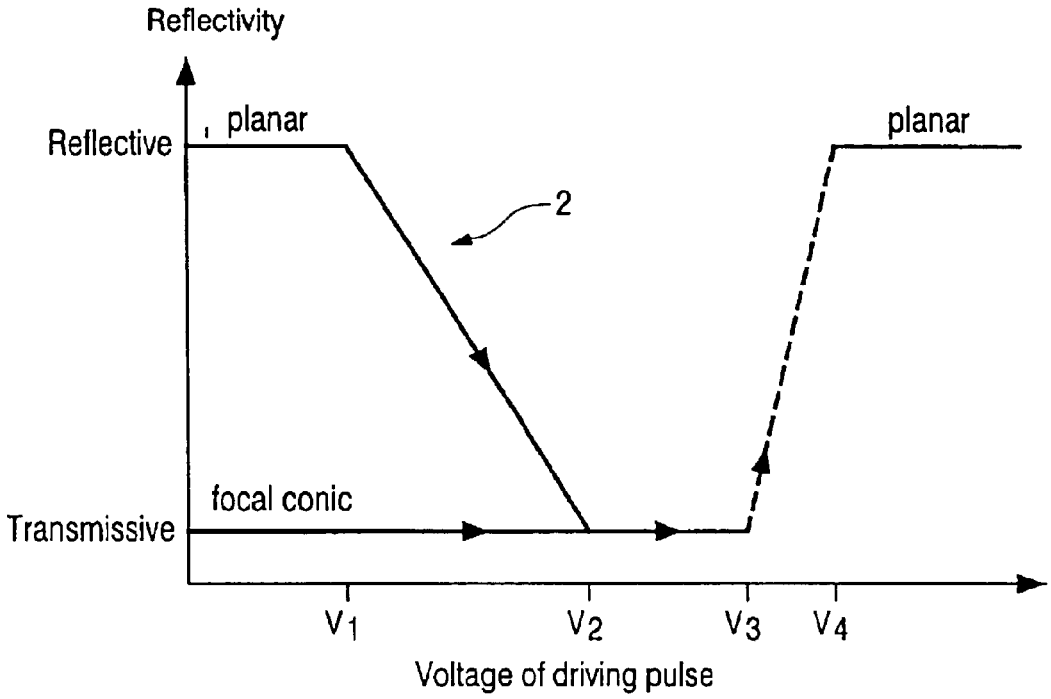
FIG. 1 shows the electro-optical response of a bistable reflective cholesteric liquid crystal.

FIG. 1 shows the electro-optical response of a bistable reflective cholesteric liquid crystal. The curves show the reflectivity after application of a square wave pulse of given voltage starting either in the stable low-voltage Planar or Focal Conic state. A voltage below $V_1$ does not change the state of the material. A voltage pulse between $V_2$ and $V_3$ switches the material to the Focal Conic state, and a voltage of $V_4$ results in the Planar state. To use the material in a liquid crystal display, the material is driven to the stable Planar or Focal Conic states with low applied voltage ($<V_1$). However, to switch between the Planar and Focal Conic states, the material must be driven to a high voltage state (not shown in FIG. 1) in which the material is transmissive. The conditions under which this high voltage is then removed from the material dictates the manner in which the material relaxes to the stable low voltage state. If the voltage is removed rapidly, the material passes through the Transient Planar state before relaxing to the stable Planar state. If the high voltage is removed more slowly, the material relaxes to the Focal Conic low-voltage stable state.

Conventional drive schemes for cholesteric displays use a passive matrix addressing scheme, which is possible as a result of the memory effect of the liquid crystal. During each field period of the addressing scheme, the material is caused to pass into the transmissive Homeotropic state. This gives rise to the black addressing bar artefact described above. In order to provide a grey scale, it has been proposed to operate the material in the region 2. This requires the material to be driven initially to the Planar state, and then requires the voltage to be altered to a value which provides the required level of reflectivity.

The invention provides a grey scale whilst maintaining the advantages of a digital drive scheme, namely one in which pixels or sub-pixels are driven only to the Planar or Homeotropic states, and not to any intermediate state. To provide a grey scale, each pixel is divided into sub-pixels, and the pixel drive signal is independently switchable by the pixel address circuit to each sub-pixel.

The invention uses an active matrix addressing scheme, namely one in which the voltage supplied to rows of pixels is selectively switchable on to the liquid crystal material of each pixel, and sub-pixel, in the row.

The use of an active matrix addressing scheme also makes it possible to dictate for each pixel (or sub-pixel) whether or not it passes to the Homeotropic state. For pixels which are in the reflective Planar state and which are to remain in the reflective Planar state, inhibiting the Homeotropic state avoids the black addressing bar problem.

Figure 2:
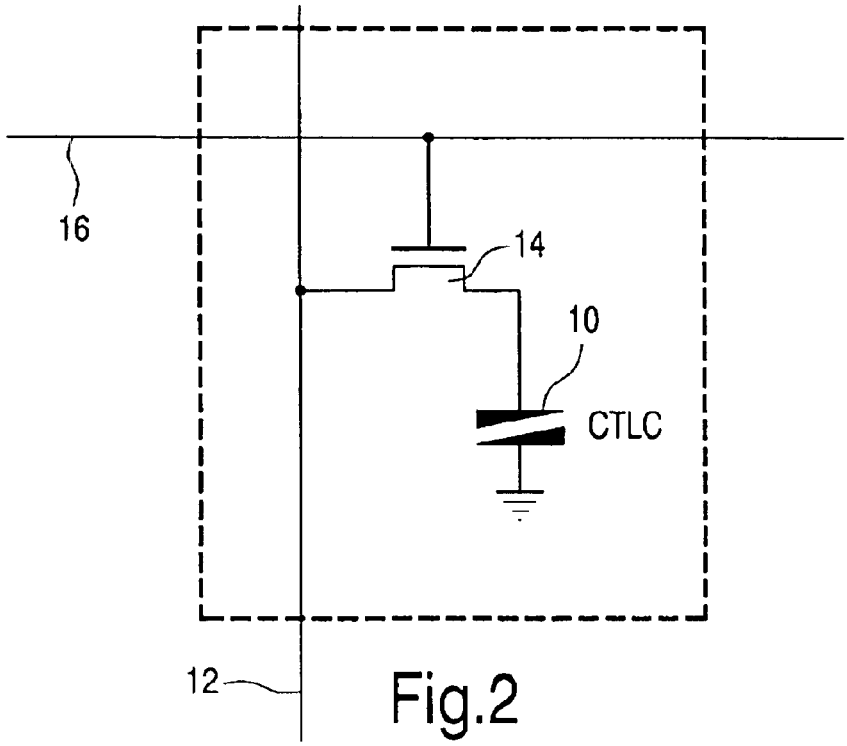
FIG. 2 is used to explain how an active matrix addressing scheme can be used to address a conventional cholesteric display pixel.

FIG. 2 shows a conventional cholesteric pixel, and is used to explain a first aspect of the invention, which enables seamless transition between video and constant signal modes of operation of the display. This is useful for applications where static images are normally required, but the display is used in a device which also provides the capability of generating video images. Such a device may comprise a mobile telephone or other hand-held device.

In the example of the invention described below, during a video mode, each pixel is driven either to the Planar or the high voltage Homeotropic state. The Homeotropic state provides greater contrast than the Focal Conic state, because the reflectivity is lower in the P state than in the FC state.

The pixel comprises a cell 10 comprising a portion of the liquid crystal material. A data signal from a column conductor 12 is supplied to the cell 10 through a high voltage thin film transistor 14, which is turned on or off by the row conductor 16 for that row of pixels.

When initially addressing the display, no charge will exist on any pixel. Therefore an initialisation is required, particularly for pixels which have relaxed from the high voltage Homeotropic state to the Focal Conic state. These pixels must be held in the high voltage black Homeotropic state for a period of around 20 ms to enable the transition between the FC and H states to occur. If all pixels are driven to the Homeotropic state, this will create one black frame before the first frame after an idle period, for example at the start of a video addressing sequence. In accordance with one aspect of the invention, a frame store is used for holding the last frame of a previous addressing sequence. This can be used to cause only those pixels in a black Focal Conic state to be transformed to a black Homeotropic state. The colour pixels in the Planar state are left untouched. This is achieved by simply addressing the display with the data in the frame store. Again this must be left for around 20 ms to allow the Focal-Conic to Homeotropic transition to occur before any further addressing occurs. The user will only perceive an increase in contrast as the video addressing mode begins, but there will be no loss of image content.

If the Focal-Conic to Homeotropic transition can occur in less than a frame time, then new data to update the display should be stored in the frame store. The old data in the frame store is used to perform the set-up described above, after which the new frame data is used. When finishing an addressing period, the last frame is left in the frame store. Then the display is always addressed with the data in the frame store and the set-up phase becomes seamless.

This enables the display to pass between standby and video modes, without any black bar artefacts. In the standby mode, at the end of a period of video mode, the pixels relax over time from the Homeotropic (high contrast) to Focal Conic (low contrast) states, whereas the pixels in the Planar state are stable.

In the video addressing mode, the required binary transitions are:

(1) Black to Black;

(2) Black to Colour;

(3) Colour to Colour; and (4) Colour to Black.

In case (1), the column voltage is set high maintaining the voltage across the pixel to maintain the Homeotropic state. After the line is addressed, sufficient charge leakage to cause relaxation of the Homeotropic state must not be allowed before refresh in the next frame. Thus, the display is operated in a high contrast mode with all pixels either in the Homeotropic or Focal Conic states.

In case (2), the column voltage is set to zero allowing rapid discharge of the pixel to the column electrode causing a transformation to the colour Planar state. In this case the optical response of the CTLC material must be less than a frame time to allow the reflecting Planar state to be reached before the pixel is addressed again. Optical response times of 20 ms are typical.

In case (3), zero voltage is held on the column, thereby maintaining zero pixel voltage, and maintaining the pixel in the stable Planar state.

In case (4), a high voltage is set on the column electrode to cause a Planar to Homeotropic state transition.

The frame store is thus used not only to smooth the interface between standby and video modes, but also to prevent the black bar artefact in the video mode, by preventing transition to the Homeotropic state for pixels which are to remain in the stable Planar state.

The liquid crystal material can be leaky. This is important for the end of the addressing mode. The final image in a video sequence will have black pixels with a large voltage initially held across them. This voltage will reduce slowly as the charge leaks away. This will cause the Homeotropic state to transform to the Focal Conic state if the charge leakage is slow enough. This gives rise to the contrast reduction explained above.

Rather than relying upon leakage through CTLC material being sufficiently slow to result in the Focal Conic state, the gate voltages of the transistors could be increased sufficiently at the end of an addressing period to let charge leak at a sufficiently slow rate to the column electrodes (which are then at zero volts).

Figure 3:
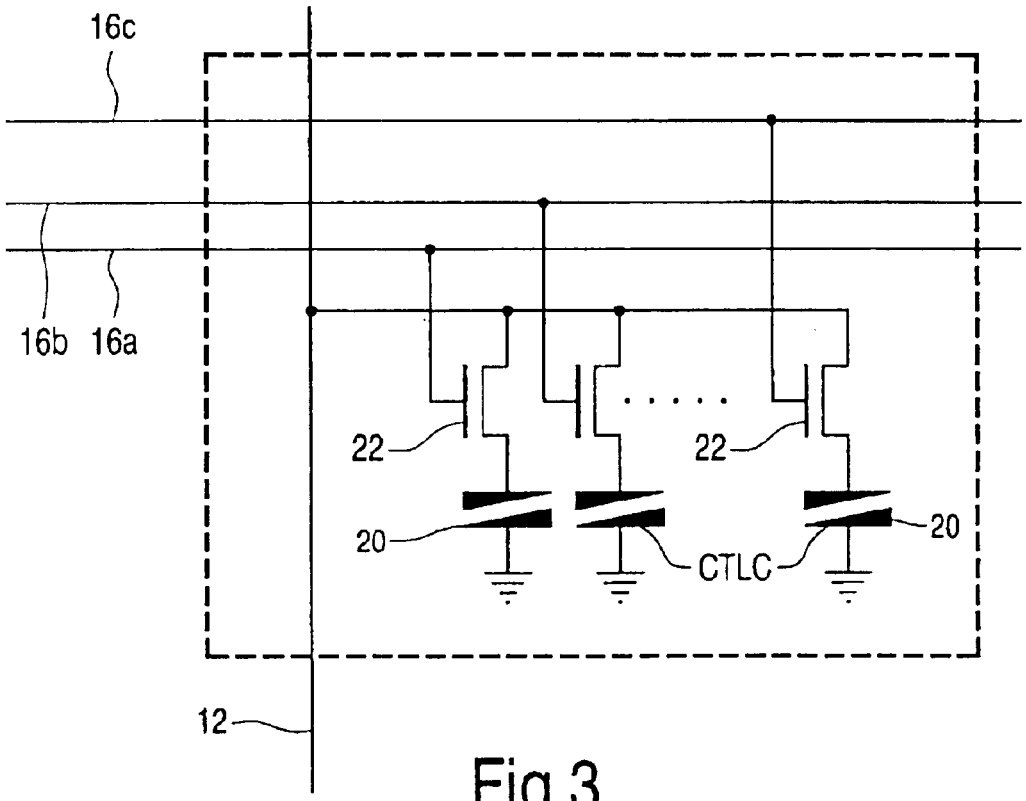
FIG. 3 shows an active matrix cholesteric display pixel design of the invention.

FIG. 3 shows an active matrix pixel design of the invention. The use of the frame store in the manner described above can be used when addressing a conventional pixel (of FIG. 2) or when addressing the pixel design of the invention.

The pixel design of the invention provides grey scale and colour by spatial division of the pixel. This enables digital rather than analogue addressing and thereby still enables the black bar addressing artefact to be avoided.

Each pixel comprises a plurality of sub-pixels 20, each of which is defined by a separate area of the liquid crystal layer. Each sub-pixel 20 has an associated transistor 22 so that each sub-pixel may be addressed independently. Each pixel requires a number of row address lines 16*a*, 16*b*, 16*c*, corresponding in number to the number of sub-pixels per pixel.

The design of FIG. 3 keeps the number of column electrodes per colour pixel down to three. The number of row electrodes is dictated by the data accuracy required, namely the number of bits per colour sub-pixel.

The liquid crystal material will be arranged into stripes either using a polymer network or using some form of separator (e.g. a glass wall) to stop colours merging. To produce colour, the circuit of FIG. 3 must be repeated under the relevant colour region of the liquid crystal layer.

Figure 4:
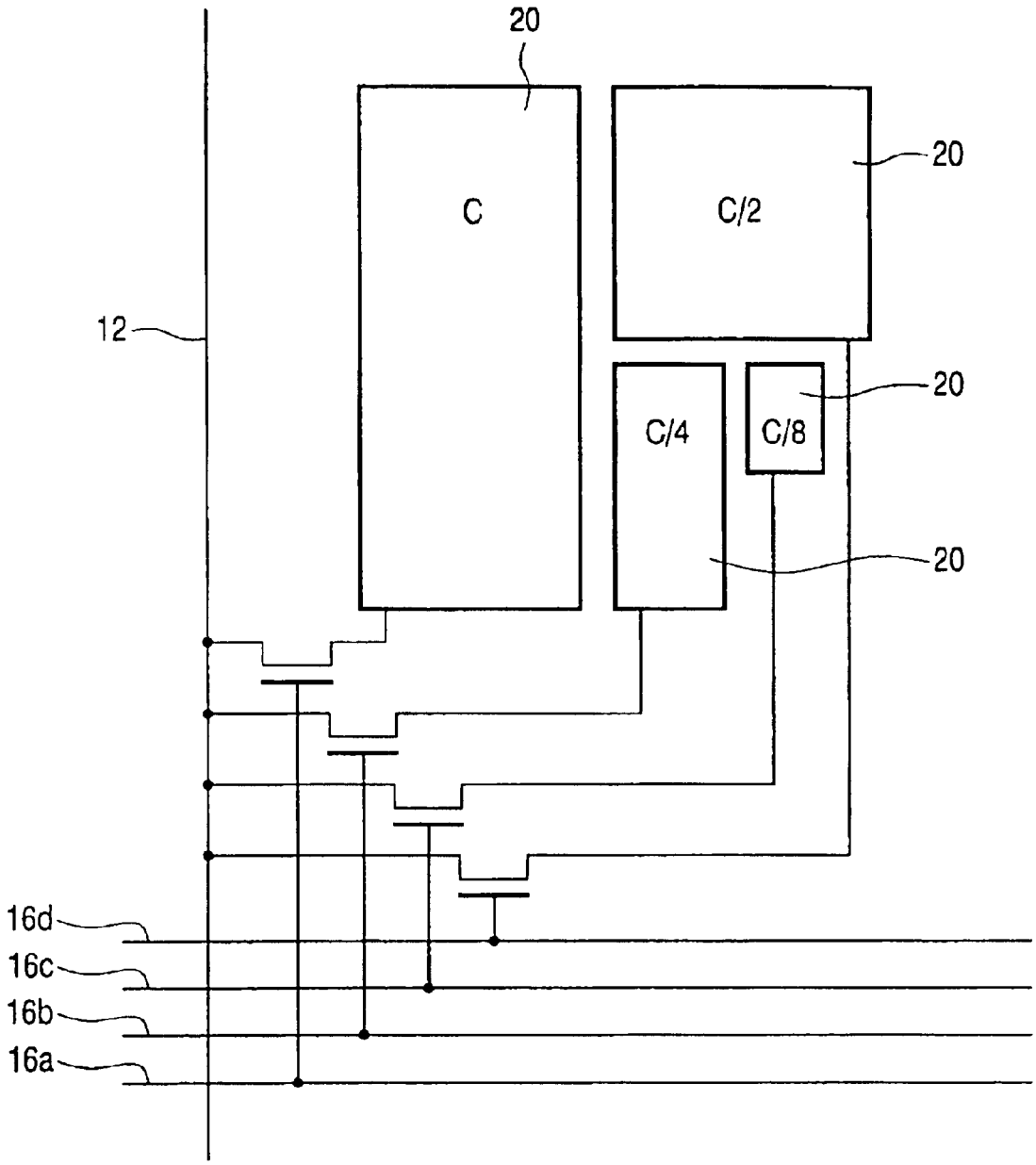
FIG. 4 shows the pixel of FIG. 3 in plan view.

The sub-pixels 20 shown in FIG. 3 will vary in size so that the various bits of the signal for the pixel can be made up. FIG. 4 shows the area variation of these sub-pixels 20, providing a binary weighted range of capacitances, C, C/2, C/4, C/8 in the example shown which provides a 4-bit grey scale (for each colour).

In order to provide the required individual row signals to each pixel in the row, the voltages are applied to each sub-pixel at an allocated time period within the overall row period, and a signal sufficient to drive the material to the Homeotropic state is applied to the columns in turn. Thus, a time division multiplexing of the column signal is carried out.

The rows and columns still only require two voltage levels, simplifying row and column driver circuits.

An alternative to the above is to have 3×b column electrodes per pixel, where b is the number of bits per colour sub-pixel. Only one row electrode is then required per pixel. This has a power saving advantage because the time division multiplexing is no longer required, reducing the number of voltage transitions per frame.

Figure 5:
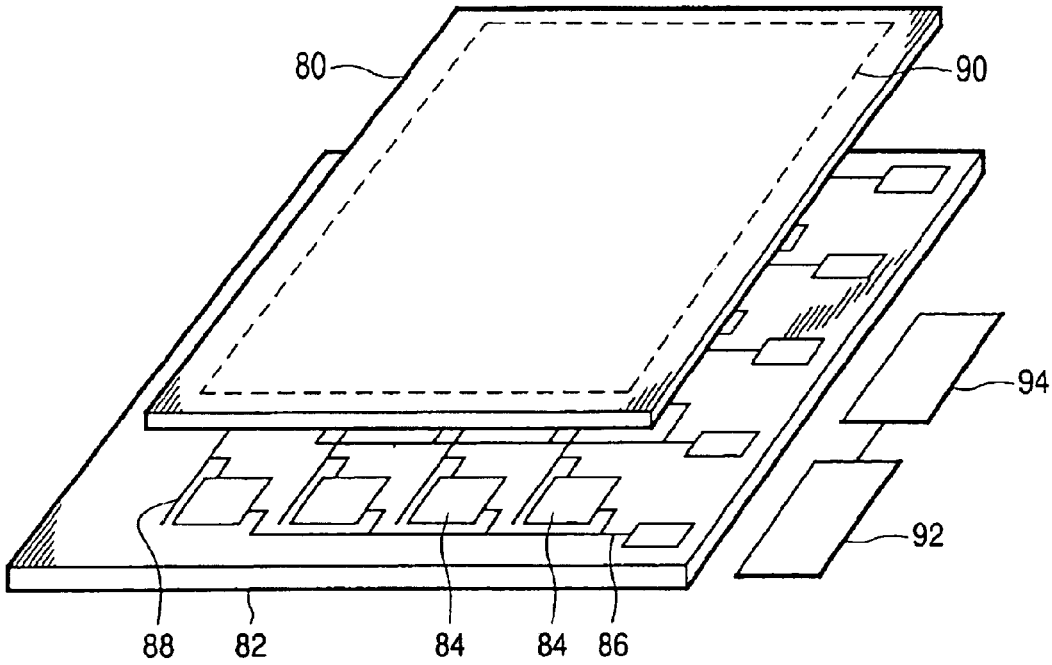
FIG. 5 shows a display according to the invention.

FIG. 5 shows a liquid crystal display device according to the invention. The device is provided with two glass substrates 80, 82 which face each other to hold liquid crystal material between them (not shown). The lower substrate 82 is the active plate which defines the pixel layout described above. Each pixel defines a contact pad 84 for the liquid crystal material. Each pixel is addressed by one or more row conductors 86 depending on the specific pixel design and one or more column conductors 88, again depending on the pixel design. The upper substrate 80 carries a common earth potential layer 90, so that individual regions of the liquid crystal material have a potential defined across them which is dictated by the potential on the contact pad 84.

A frame store is shown schematically as 92 which is accessed by the drive electronics 94 of the display.

The active plate can be manufactured using known techniques, for example using the same processes used to form the active plate of a conventional active matrix liquid crystal display. Thus, the required transistors and capacitor plates are formed using thin film techniques, and the transistors may be defined as amorphous silicon or polycrystalline silicon devices.

The inversion of voltages is desirable to maintain a zero mean field across the liquid crystal material. This can be achieved by addressing the black pixels with alternating positive and negative voltages in different fields. However this doubles the already high voltages on the columns. Using counter electrode inversion will bring the column voltage range back to the non-voltage inversion case, but the column voltage levels will change to +/−V/2 Volts (rather than 0 and V Volts) to achieve r.m.s. pixel voltages of 0 and V Volts where required.

Various modifications will be apparent to those skilled in the art.

What is claimed is:

1. A display apparatus comprising:

a layer of bistable chiral nematic liquid crystal material;

a memory; and an active matrix substrate defining rows and columns of pixel address circuits, wherein each pixel address circuit has an input for receiving a data signal and a plurality of outputs, wherein each output is for applying a pixel drive signal to a respective portion of the liquid crystal material, wherein the pixel drive signal for each output is independently switchable by the pixel address circuit to each output, and wherein the memory is used for determining which pixels need to be driven to the Homeotropic state based on the pixel outputs in the previous and current frames.

2. A display device as claimed in claim 1, wherein the different portions of the liquid crystal material occupy different sized areas of the layer of material.

3. display device as claimed in claim 2, wherein the areas of the different portions follow a binary-weighted scale.

4. A display device as claimed in claim 1, wherein the layer of material comprises a red, green and blue region.

5. A display device as claimed in claim 1, wherein each pixel has a single input, and the input is coupled to each output through a respective transistor, each transistor having an independently selectable gate voltage.

6. A display device as claimed in claim 1, wherein each pixel has a plurality of inputs, and each input is coupled to an associated output through a respective transistor, a common controllable gate voltage being applied to each transistor.

7. A display device as claimed in claim 1, wherein each pixel address circuit has four outputs.

8. A display device as claimed in claim 1, which is drivable in a non-addressing mode and an addressing mode, wherein the memory is used to store data enabling transition between the two modes.

9. A method of addressing a bistable chiral nematic liquid crystal display apparatus, the apparatus comprising an active matrix substrate defining rows and columns of pixel address circuits, each pixel address circuit having a plurality of outputs, wherein each output is for applying a pixel drive signal to a respective portion of the liquid crystal material, the method comprising:

for each row of pixels, applying a pixel drive signal to a number of the outputs of each pixel address circuit, the number of the outputs being selected as a function of the desired pixel output level; and using a memory for determining which pixels need to be driven to a Homeotropic state based on the pixel outputs in the previous and current frames.

10. A method as claimed in claim 9, wherein the pixel drive signal is sufficient to drive the material initially to the Homeotropic state.

11. A method as claimed in claim 10, wherein for pixel outputs in the Planar state in the preceding frame and to be driven to the Planar state in the current frame, the pixel drive signal is not applied.

12. A method as claimed in claim 10, wherein the pixel drive signal is positive for some frames and negative for other frames.

13. A method of addressing a bistable chiral nematic liquid crystal display apparatus, the apparatus comprising an active matrix substrate defining rows and columns of pixel address circuits, the method comprising:

applying an initialisation sequence, in which for each row of pixels a pixel drive signal is applied only to those pixels previously in the transmissive Focal Conic state, thereby driving those pixels to the transmissive Homeotropic state, the state of the pixels previously being determined from a frame store; and using the frame store for determining which pixels need to be driven to the Homeotropic state based on the pixel outputs in the previous and current frames.

* * * * *